US005746375A

United States Patent [19]

Guo

[11] Patent Number: 5,746,375

[45] Date of Patent: May 5, 1998

[54] SPRAYER DEVICE

[76] Inventor: Wen-Li Guo, No. 10, Fang Dong Road, Wen Gin Tsuen, Fang Yuan Hsiang, Chang Hua Hsien, Taiwan

[21] Appl. No.: 655,816

[22] Filed: May 31, 1996

[51] Int. Cl.[6] ..... B05B 3/00

[52] U.S. Cl. ..... 239/245; 239/251; 239/276; 239/394; 239/397

[58] Field of Search ..... 239/225.1, 251, 239/243, 245, 273, 276, 390–4, 397, 436, 443, 449

[56] References Cited

U.S. PATENT DOCUMENTS

| | | | |
|---|---|---|---|
| 922,664 | 5/1909 | Burden | 239/276 |
| 1,847,763 | 3/1932 | Keys | 239/251 |
| 3,081,950 | 3/1963 | Rinkewich | 239/436 |
| 4,193,549 | 3/1980 | Gladstone | 239/251 |
| 4,347,981 | 9/1982 | Hayes | 239/394 |
| 4,905,903 | 3/1990 | Katzer et al. | 239/436 |
| 5,419,494 | 5/1995 | Harwood | 239/251 |

*Primary Examiner*—Andres Kashnikow
*Assistant Examiner*—Lisa Ann Douglas
*Attorney, Agent, or Firm*—Charles E. Baxley

[57] ABSTRACT

A sprayer device includes a base rotatably supported on a housing and having an inner chamber for receiving water. A rotary member is rotatably secured on the base and may receive water from the base. The rotary member includes one or more rows of radially aligned holes each having a slope for allowing the water to flow out of the rotary member in a slope and for allowing the water to apply a force against the rotary member so as to rotate the rotary member relative to the base. A handle is pivotally coupled to the housing and includes a stick for securing to the ground.

3 Claims, 4 Drawing Sheets

SPRAYER DEVICE

BACKGROUND OF THE INVENTION

1. Field of the Invention

The present invention relates to a sprayer, and more particularly to a sprayer device having a rotatable sprinkling member.

2. Description of the Prior Art

Typical sprayer devices normally includes gun body for allowing the hand grip of the user. However, the sprayer devices may not be stably disposed on the ground and may not be provided as a sprinkling device when the sprayer device is disposed on the ground.

The present invention has arisen to mitigate and/or obviate the afore-described disadvantages of the conventional sprayer devices.

SUMMARY OF THE INVENTION

The primary objective of the present invention is to provide a sprayer device which can be disposed on ground and which includes a rotatable sprinkling member.

In accordance with one aspect of the invention, there is provided a sprayer device comprising a base including an inner chamber formed therein for receiving water therein, the base including an upper portion having an aperture formed therein, and a rotary member including a tube extended downward and engaged through the aperture and rotatably secured to the base, the tube being arranged to allow the water to flow from the base into the rotary member, the rotary member including at least one row of radially aligned holes formed therein, the holes including a slope for allowing the water to flow out of the rotary member in a slope and for allowing the water to apply a force against the rotary member so as to rotate the rotary member relative to the base.

A housing includes at least one room formed therein, includes a water inlet for allowing water to flow into the room, and includes an outlet for allowing the water to flow out of the housing, the housing includes a center portion having a recess formed therein, the base includes a stud rotatably engaged in the recess of the housing and includes a bottom plate for blocking the outlet, the base includes a plurality of nozzles for aligning with the outlet so as to receive water from the outlet, the bottom plate includes an aperture formed therein for aligning with the outlet and for allowing the water to flow into the inner chamber of the base.

The housing includes an opening for engaging with a hand of a user and for carrying the sprayer device.

A handle includes a middle portion pivotally coupled to the housing at a shaft and includes a handgrip formed in one end for aligning with the opening of the housing, the handle includes a stick extended therefrom for engaging with a ground so as to stably secure the sprayer device in place.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
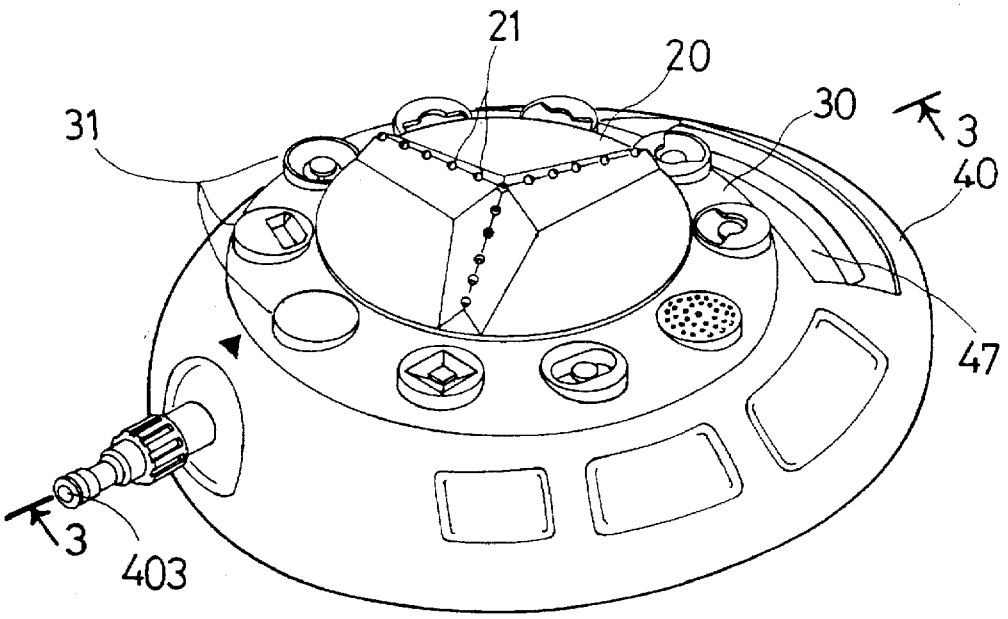
FIG. 1 is a perspective view of a sprayer device in accordance with the present invention.
Figure 2:
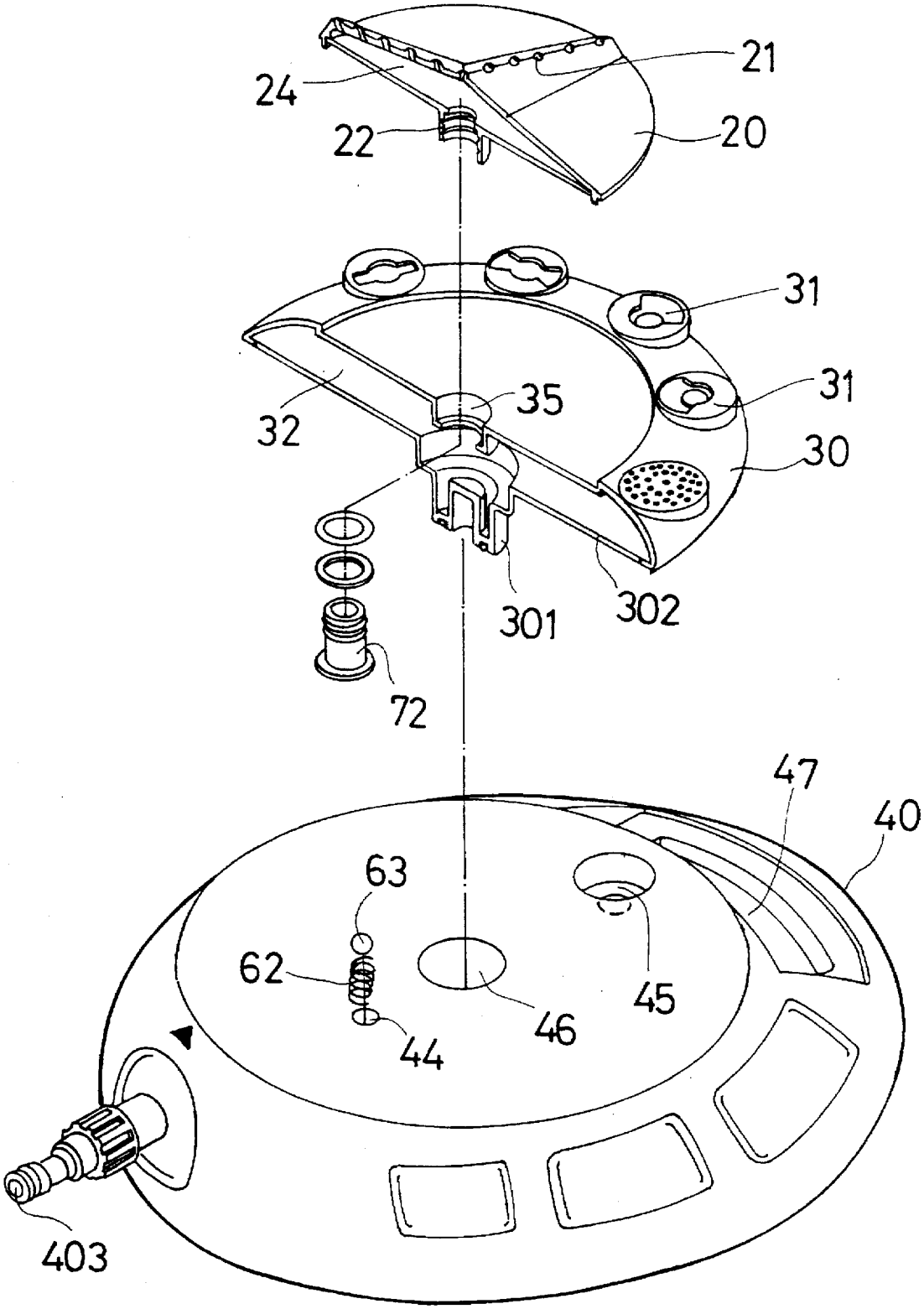
FIG. 2 is an exploded view of the sprayer device.
Figure 3:
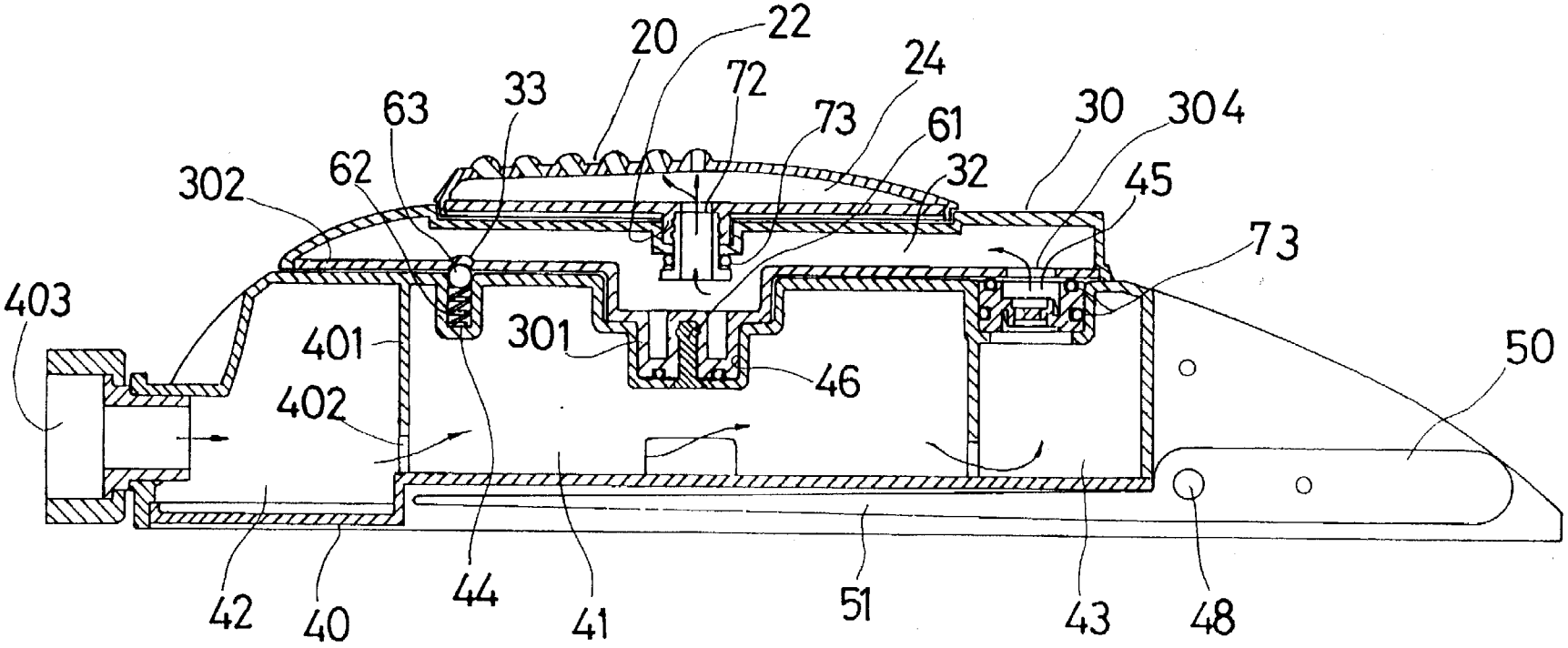
FIGS. 3 and 4 are cross sectional views taken along lines 3—3 of FIG. 1.

Referring to the drawings, and initially to FIGS. 1 to 3, a sprayer device in accordance with the present invention comprises a housing 40 including three rooms 41, 42, 43 separated and formed by partition plates 401 and communicating with each other by orifices 402. The housing 40 includes an upper portion having a cavity 44 formed therein for engaging with a projection means which includes a spring 62 and a ball 63. The housing 40 includes a recess 46 formed in the center portion and includes an outlet 45. The housing 40 includes a water inlet 403 for coupling the housing 40 to a water reservoir. The water from the inlet 403 may flow out through the outlet 45 via the rooms 42, 41, 43 and the orifices 402. The housing 40 includes an opening 47 for engaging with the hand of the user such that the housing 40 can be carried by the user.

A base 30 includes a stud 301 rotatably engaged in the center recess 46 and secured in place by a pin element 61. The base 30 includes a bottom plate 302 for blocking the outlet 45, and includes a number of nozzles 31 for aligning with the outlet 45 (FIG. 4) so as to receive water from the outlet 45. The bottom plate 302 includes an aperture 304 for aligning with the outlet 45 and for allowing the water to flow into the inner chamber 32 of the base 30. The bottom plate 302 includes a number of depressions 33 (FIG. 3) formed therein for engaging with the projection 63 so as to stably align the nozzles 31 and the aperture 304 with the outlet 45 of the housing 40. The base 30 includes an aperture 35 formed in the upper and center portion thereof.

A rotary member 20 includes a tube 22 extended downward and engaged through the aperture 35 and rotatably secured to the base 30 by a cylindrical member 72. A sealing ring 73 is engaged with the cylindrical member 72 so as to form a water tight seal between the rotary member 20 and the base 30. The water from the base 30 may flow into the interior 24 of the rotary member 20 via the tube 22 and the cylindrical member 72. The rotary member 20 includes one or more rows of radially aligned holes 21. The holes 21 are inclined having a suitable slope so as to allow the water to flow out of the rotary member 20 in a slope. The inclinedly outward flow of the water may apply a relative force against the rotary member 20 so as to force and to rotate the rotary member 20 relative to the base 30.

Figure 4:
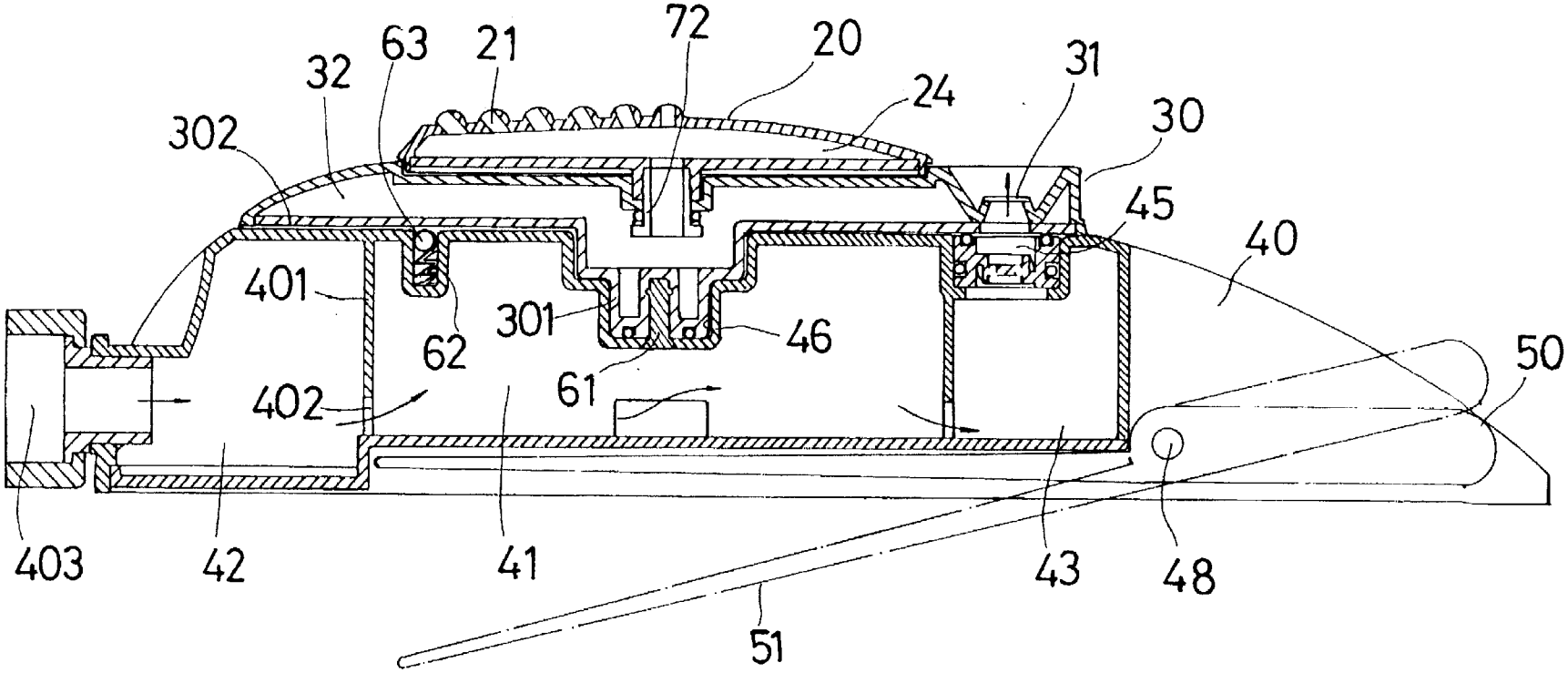

In operation, as shown in FIG. 3, when the water from the housing 40 flows into the interior 24 of the rotary member 20 via the outlet 45 and the aperture 304, the water may flow out of the rotary member 20 via the holes 21 and may apply a relative force against the rotary member 20 so as to rotate the rotary member 20. As shown in FIG. 4, when either of nozzles 31 is aligned with the outlet 45, water is allowed to flow out of the nozzle 31.

Figure 5:
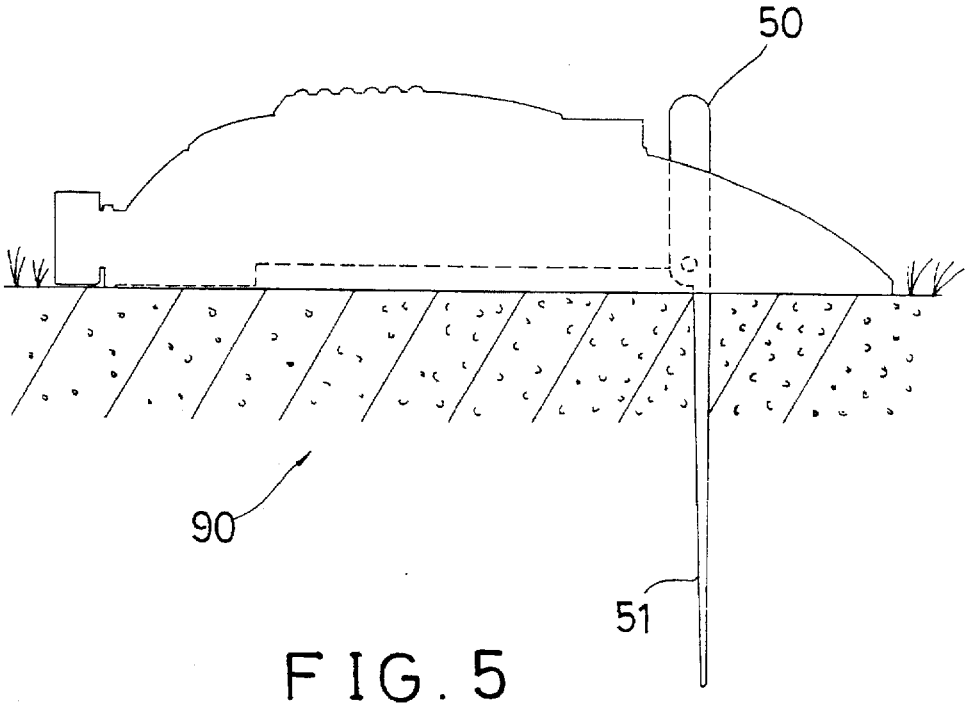
FIG. 5 is a schematic view illustrating the operation of the sprayer device.

Referring next to FIG. 5 and again to FIGS. 1, 3, and 4, a handle 50 has a middle portion pivotally coupled to the housing 40 at a shaft 48 and includes a handgrip formed in one end for aligning with the opening 47 of the housing 40. The handle 50 includes a stick 51 extended therefrom for engaging with the ground 90 (FIG. 5) so as to stably secure the sprayer device in place.

It is noted that the housing 40 includes three rooms 41, 42, 43 having a large volume for receiving water therein such that the weight of the water received in the rooms may further stably retain the sprayer device in place.

Accordingly, the sprayer device in accordance with the present invention includes a rotary member 20 that may be rotated by the outward water flow, and includes a handle having a stick that may engage into the ground so as to stably retain the sprayer device in place. In addition, the housing includes a large room therein for receiving water which may further stably retain the sprayer device in place.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sprayer device comprising:

a base including an inner chamber formed therein for receiving water therein, said base including an upper portion having an aperture formed therein, a rotary member including a tube extended downward and engaged through said aperture and rotatable secured to said base, said tube being arranged to allow the water to flow from said base into said rotary member, said rotary member including at least one row of radially aligned holes formed therein, said holes including a slope for allowing the water to flow out of said rotary member in a slope and for allowing the water to apply a force against said rotary member so as to rotate said rotary member relative to said base, and a housing including at least one room formed therein, including a water inlet for allowing water to flow into said room, and including an outlet for allowing said water to flow out of said housing, said housing including a center portion having a recess formed therein, said base including a stud rotatably engaged in said recess of said housing and including a bottom plate for blocking said outlet, said base including a plurality of nozzles for aligning with said outlet so as to receive water from said outlet, said bottom plate including an aperture formed therein for aligning with said outlet and for allowing the water to flow into said inner chamber of said base.

2. A sprayer device according to claim 1, wherein said housing includes an opening for engaging with a hand of a user and for carrying said sprayer device.

3. A sprayer device according to claim 2 further comprising a handle including a middle portion pivotally coupled to said housing at a shaft and including a handgrip formed in one end for aligning with said opening of said housing, said handle including a stick extended therefrom for engaging with a ground so as to stably secure said sprayer device in place.

* * * * *